US005750932A

United States Patent [19]

Hansson

[11] Patent Number: 5,750,932

[45] Date of Patent: May 12, 1998

[54] MULTI-CORE CABLE FOR ELECTRICALLY COMMUNICATING A HAND HELD POWER NUTRUNNER WITH A POWER SUPPLY AND CONTROL UNIT

[75] Inventor: Gunnar Christer Hansson, Stockholm, Sweden

[73] Assignee: Atlas Copco Tools AB, Nacka, Sweden

[21] Appl. No.: 433,477

[22] PCT Filed: Nov. 9, 1993

[86] PCT No.: PCT/SE93/00944

§ 371 Date: May 8, 1995

§ 102(e) Date: May 8, 1995

[87] PCT Pub. No.: WO94/11887

PCT Pub. Date: May 26, 1995

[30] Foreign Application Priority Data

Nov. 9, 1992 [SE] Sweden ..... 9203340

[51] Int. Cl.[6] ..... H01B 7/00

[52] U.S. Cl. ..... 174/113 R; 174/117 F

[58] Field of Search ..... 174/113 R, 110 R, 174/117 F, 36, 113 C

[56] References Cited

U.S. PATENT DOCUMENTS

| | | | |
|---|---|---|---|
| 1,828,614 | 10/1931 | Obermaier . | |
| 2,663,755 | 12/1953 | McBride | 174/117 F |
| 3,013,109 | 12/1961 | Gorman et al. | 174/113 R |
| 3,060,260 | 10/1962 | Scofield | 174/117 F |
| 3,212,046 | 10/1965 | Abel et al. | 339/1 |
| 3,574,015 | 4/1971 | Blee | 156/47 X |
| 3,818,122 | 6/1974 | Luetzow | 174/86 |
| 4,847,443 | 7/1989 | Basconi | 174/32 |
| 4,861,947 | 8/1989 | Altermatt et al. | 174/113 C X |
| 5,203,242 | 4/1993 | Hansson | 81/469 X |
| 5,296,648 | 3/1994 | Johnson | 174/117 F |
| 5,502,287 | 3/1996 | Nguyen | 174/113 R |

FOREIGN PATENT DOCUMENTS

| | | |
|---|---|---|
| 1 465 974 | 1/1970 | Germany . |
| 2 241 374 | 8/1991 | United Kingdom . |

*Primary Examiner*—Bot L. Ledynh
*Assistant Examiner*—Chau N. Nguyen
*Attorney, Agent, or Firm*—Frishauf, Holtz, Goodman, Langer & Chick

[57] ABSTRACT

A multi-core cable (15) for communicating electric power and electrical signals to and from a hand held power nutrunner (10). Three longitudinal sections (16–18) are arranged in parallel with each other, and each has a geometric center (20–22) such that in any cross section of the cable (15) the geometric centers (20–22) are disposed on a straight line (24). A flex zone (A) is arranged adjacent the nutrunner (10) and has a preformed longitudinally twisted shape for obtaining a universal flexibility of the cable (15) and, thereby, a comfortable handling of the nutrunner (10).

13 Claims, 1 Drawing Sheet

MULTI-CORE CABLE FOR ELECTRICALLY COMMUNICATING A HAND HELD POWER NUTRUNNER WITH A POWER SUPPLY AND CONTROL UNIT

BACKGROUND OF THE INVENTION

1. Field of the Invention

This invention relates to a multi-core cable intended for communicating electric power and electrical signals to and from a hand held power nutrunner.

In particular, the invention concerns a multi-core cable of the type having two or more sections each with a geometric centers and extending in parallel with each other such that in any cross section of the cable the geometric center are disposed on-a straight line.

2. Description of the Prior Art

In the prior art, electric communication with hand held power nutrunners is accomplished via cables with the electrical conductors arranged in concentrically disposed cores, i.e. cables with a substantially circular cross section.

One drawback inherent in cables of this known type is that, although they are universally flexible, they tend to be rather stiff, because the high number of conductive cores causes a large outer diameter of the cable and, accordingly, a large radius from the center of the cable to the outermost located cores.

This causes not only a stiffer cable and a more awkward handling of the power nutrunner, but results in high tension forces and large relative displacement of the outermost cores at bending of the cable. This results in turn in a shorter service life of the cable since frictional wear and the risk for breakage of the outer cores are high.

Another problem concerning prior art concentric cables refers to the electrical distortion on the signals communicated from the nutrunner. This is caused by the electromagnetic field existing around the power supplying cores connecting the nutrunner motor to a power source, and since the signal and power supplying cores are located very closely to each other the electromagnetic influence on the signals is inevitable.

A solution to the above mentioned problems is obtained by using a flat type of cable wherein a better separation of the power and signal communicating cores may be obtained as well as a shorter distance to the cable centre in one direction for the outermost cores. The latter feature is advantageous since it causes less tension and displacement of the outermost cores at bending of the cable in the direction of the small dimension of the cable. The bending force in that direction is substantially lower as well compared to a prior art concentric type of cable.

However, using such a flat type of cable with two or more core sections located in parallel brings another problem to which this invention is a solution, namely how to reduce the bending forces as well as the core tensions caused in the direction of the large dimension of the cable. The large dimension of such a flat type of cable is much larger that the outer diameter of a concentric type of cable which means that the flat type of cable is almost completely stiff in that direction. This means that such a cable would make the handling of the nutrunner very awkward.

A further problem inherent in prior art cables of circular outer shape refers to the difficulty to discover whether the cable has been unintentionally twisted during use of the nutrunner. Such twisting the cable easily leads to tangling of the cable which in turn might cause damage to the cable itself as well as impairment of the nutrunner handling. This problem is solved by using a flat type of cable, twisting of which is easy to observe.

SUMMARY OF THE INVENTION

An object of the invention is to solve the above problems. The multi-core flat type cable of the present invention for communicating electric power and electrical signals between a hand held power nutrunner (10) and a power supply and control unit (14) comprises at least three longitudinal sections (16–18) extending in parallel with each other. The at least three longitudinal sections (16–18) each have a geometric center (20–22) such that in any cross section of the cable (15) the geometric centers (20–22) are disposed on a straight line (24). The flat multi-core flat type cable (15) includes a first portion (A) extending from the nutrunner (10) and a second portion (B) extending from the power supply and control unit (14). The second portion (B) meets the first portion (A). The first portion (A) is preformed in a longitudinally twisted shape to form a flex zone for providing a universal easy bending of the cable (15), and the first portion (A) has a length that is substantially shorter than a length of the second portion (B).

DESCRIPTION OF THE PREFERRED EMBODIMENT

Figure 1:
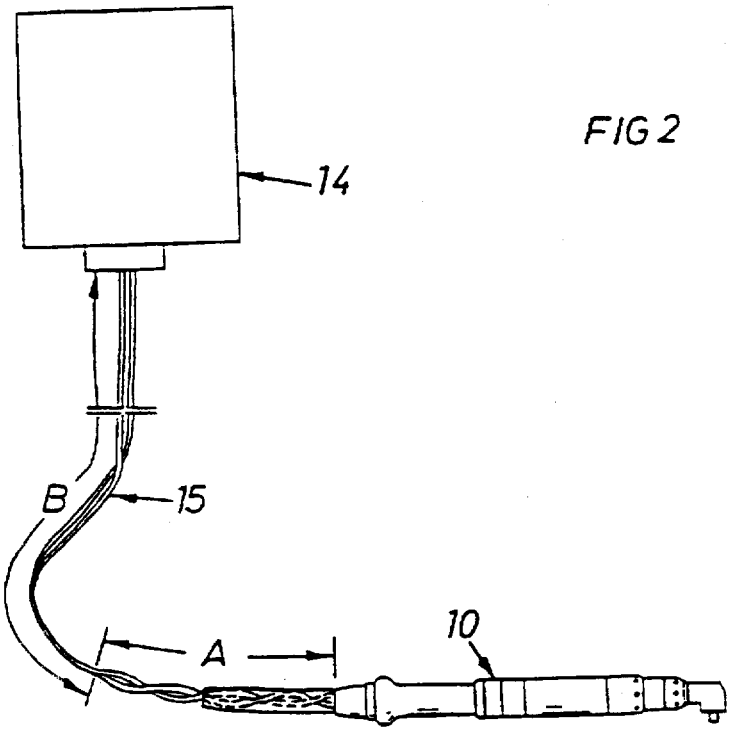
FIG. 1 shows a power nutrunner connected to a control and monitoring unit by means of a cable according to the invention.

The device shown in FIG. 1 comprises an electric power nutrunner 10 having a handle 11 for manual support of the nutrunner 10 and a multi connector jack 12 interconnected with a mating multi connector plug 13 mounted at the end of a cable 15.

Via the cable 15 the nutrunner 10 is coupled to a unit 14 comprising electronic control and monitoring equipment by which the operation of the nutrunner is governed. This equipment comprises power supply means, tightening process controlling and monitoring means, means for data storing and documentation etc.

The cable 15 is of a flat type comprising three parallel sections 16, 17 and 18. Each of these sections has a geometric center 20, 21, and 22 respectively, and all three of these geometric centers 20, 21, 22 are disposed on a straight line 24. This straight line disposition of the section centers 20, 21, 22 is maintained throughout the length of the cable 15.

One of the cable section 16 comprises a number of cores for communicating electric power to the nutrunner 10.

Another section 18 comprises a number of signal communicating cores coupled to signal producing means like torque transducer, angle encoder, temperature sensor etc. in the nutrunner 10.

A third section 17, situated between the two other sections 16, 18 does not comprise any electric conductors at all, but includes a cable support line by which the other two sections are relieved from tension forces.

This electrically inert section 17 also serves as a distance means for separating the power supplying cores of section 16 from the signal communicating cores of section 18, thereby reducing considerably the electromagnetic distortions on the signals transmitted from the nutrunner 10 to the control and monitoring equipment coupled to the nutrunner 10.

All three sections 16, 17, 18 are firmly kept in the flat cable type disposition by a synthetic resin moulding 25, such that the large transverse dimension b is about three times the small dimension a. See FIG. 2.

As illustrated in FIG. 1, the cable 15 comprises a flex zone A located adjacent the nutrunner, in which zone the cable 15 is preformed to a 180° twisted shape. This is accomplished by heat treatment of the cable in a specially designed fixture, wherein the synthetic resin moulding 25 adopts a twisted shape without changing the relative positions of the core sections 16, 17, 18. Accordingly, the geometric centers 20, 21, 22 of these sections are maintained on the straight line 24.

The flex zone A forms just a minor part of the total length of the cable, which means that the rest of the cable, which forms a second portion B, has a straight nontwisted preforming. This makes it possible to check visually the cable for any undesirable twisting that might cause kinks and damage to the cable itself as well as an impaired handling of the nutrunner.

In, for instance, assembly line use of electric nutrunners a common problem is that the cable gets unintentionally twisted due to repeated half way turns each time the operator picks up the tool and returns it to a rest position. So after several operation cycles the cable may have been undesireably twisted shape and, hence, the nutrunner handling impaired.

In one example successfully used in practice, the cable has a total length of 5.0 m and comprises a flex zone of 0.6 m adjacent the nutrunner. The flex zone has a 180° twist angle and offers a comfortable handling of the tool.

By the introduction of the flex zone A in accordance with the invention, the flat type of multi-core cable has been made universally flexible for ensuring a comfortable handling of the nutrunner. In other words, the invention has made it possible to use a flat type of cable for this purpose, which in turn has made it possible to improve not only the service life of a multi-core cable for hand held power nutrunners but to obtain more reliable and less distorted signals from the tool.

By the invention, it has been possible to use a type of cable where the safety against short circuiting between the power supply cores and the signal transmitting cores is substantially improved as well. This is an important feature for protecting equipment as well as personell against hazardous voltage.

It is to be noted though that the invention is not limited to the above described example, but can be varied within the scope of the claims. For example, the number of parallel core sections is not limited to three, and the shape of the flex zone A could have any twist angle from about 180° and upwards. The above described embodiment including a 180° twist is an example of a well operating flex zone.

At repeated bending of a flat type cable a certain angle a certain length of the cable has to be involved in the bending movement to avoid fatigue stresses in the cable, which length is determined by the endurability to bending of the cable, i.e. the permissible minimum radius of curvature.

To obtain a universal bending ability of the cable a portion of the cable is preformed in a twisted shape to form a flex zone A. Bending of the cable in the flex zone A in any direction means that the actual bending takes place only in those portions of the cable in which the weakest section is disposed in the bending direction. As a matter of fact, there is only a limited portion C of the cable per half twisting turn that has the weakest section in any bending direction.

Figure 2:
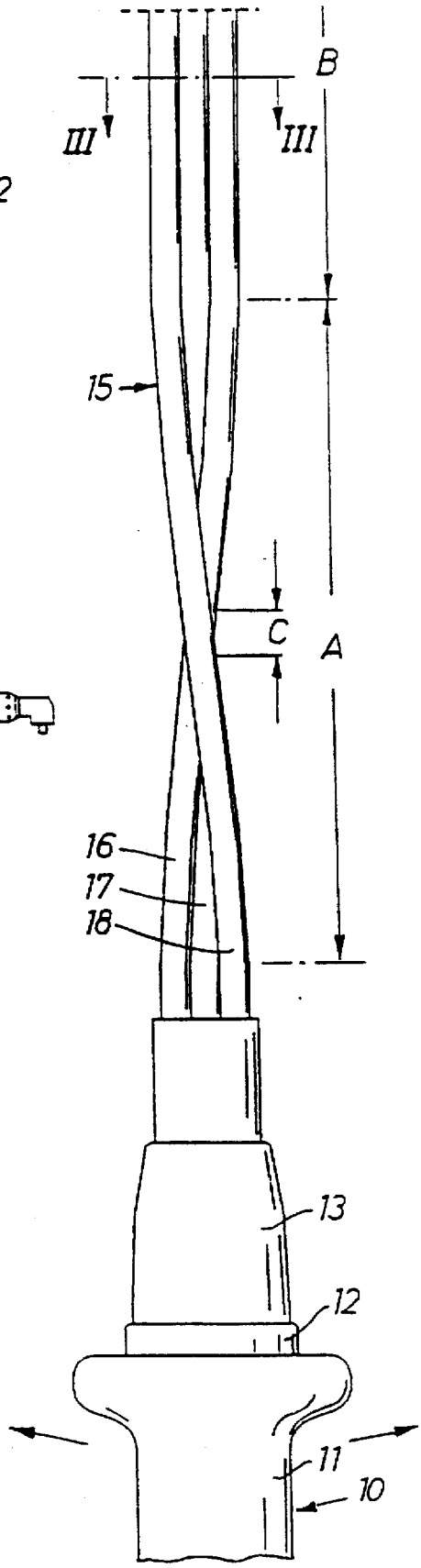
FIG. 2 shows the rear part of a power nutrunner to which a cable according to another embodiment of the invention is connected.
Figure 3:
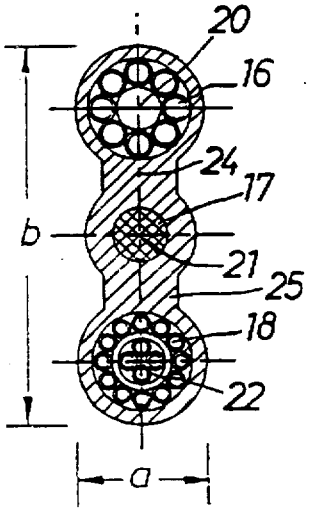
FIG. 3 is a cross section of the cable taken along line III—III in FIG. 2.

In FIG. 2 the weak portion C is illustrated on that part of the cable which is the weakest section at bending in directions illustrated by the arrows.

Accordingly, there is only a fraction x % of the flex zone length that forms the weakest portion in any randomly chosen bending direction. This weak portion C has to have a sufficient length 1 such that the limit for the bending ability for the cable is not exceeded at bending over a larger angle. To achieve this, the length L of the flex zone is:

$$\frac{100}{x} \times 1.$$

Depending on the relationship between the width b and thickness a of the cable, the weak portion C of the flex zone A varies in length between 10% and 30%, the greater the relationship between width b and thickness a the smaller portion of the flex zone A is formed by the weak portion C for a certain pitch of the twisted shape.

Depending on the bending direction of the tool the weak portion C of the flex zone A will be located at different distances from the tool. In a case where the tool is articulated in the direction in which the cable section closest to the tool has its stiffest characteristic, and the cable flex zone A has its minimum acceptable twisting angle of 180°, the cable will be bent in the very centre of the flex zone. Accordingly, this particular bending direction makes the cable bend at its weakest portion C which is located at a distance from the tool equal to half the length of the flex zone A. In certain cases, this distance can be too large to obtain a comfortable handling of the tool. This single point deflection of the cable may also turn out to be uncomfortable for the operator and unfavourable for the service life of the cable. To distribute more evenly the bending movement of the cable, the twisted shape of the flex zone may comprise several full or half turns to accomplish more weak portions in each and every bending direction.

To ensure comfortable handling of the tool, the length of the flex zone A may not be too long. The suitable length of the flex zone A is ½–3 times the largest dimension of the tool, or 1 m at the most.

I claim:

1. A multi-core flat type cable (15) for communicating electric power and electric signals between a hand held power tool (10) and a power supply and control unit (14), said multi-core flat type cable (15) comprising at least three parallel longitudinally extending sections (16–18) each having a geometric center (20–22), wherein:

said longitudinally extending sections (16–18) are arranged such that in any cross section of said multi-core flat type cable (15) said geometric centers (20–22) are disposed on a straight line (24), a first one (16) of said longitudinally extending sections (16–18) contains a plurality of signal communicating cores only, a second one (18) of said longitudinally extending sections (16–18) contains a plurality of power supply cores only, a third one (17) of said longitudinally extending sections (16–18) is formed without any conductors and is located between said first one (16) and said second one

(18) of said longitudinally extending sections (16–18), said third one (17) of said longitudinally extending sections (16–18) thereby forming a spacing member for physically separating said plurality of signal communicating cores from said plurality of power supply cores by a predetermined distance, said multi-core flat type cable (15) comprises a first longitudinally extending portion (A) extending from the power tool (10), said first longitudinally extending portion (A) being preformed in a longitudinally twisted shape to form a flex zone for providing a universal easy bending of said multi-core flat type cable (15), and said longitudinally twisted shape comprises a twisting of at least 180°.

2. The cable according to claim 1, further comprising:

a second longitudinally extending portion (B) extending from the power supply and control unit (14) and meeting said first longitudinally extending portion (A).

3. The cable according to claim 2, wherein said first longitudinally extending portion (A) has a length of approximately ½ to 3 times a largest dimension of the power tool (10).

4. The cable according to claim 2, wherein said third one (17) of said longitudinally extending sections (16–18) includes a cable support line for relieving longitudinal forces applied to said multi-core flat type cable (15).

5. The cable according to claim 2, wherein a large transverse dimension (b) of said longitudinally extending sections (16–18) is approximately three times that of a small transverse dimension (a) of said longitudinally extending sections (16–18).

6. The cable according to claim 4, wherein a large transverse dimension (b) of said longitudinally extending sections (16–18) is approximately three times that of a small transverse dimension (a) of said longitudinally extending sections (16–18).

7. The cable according to claim 2, wherein said second longitudinally extending portion (B) is preformed in a straight nontwisted shape.

8. The cable according to claim 3, wherein said third one (17) of said longitudinally extending sections (16–18) includes a cable support line for relieving longitudinal forces applied to said multi-core flat type cable (15).

9. The cable according to claim 3, wherein a large transverse dimension (b) of said longitudinally extending sections (16–18) is approximately three times that of a small transverse dimension (a) of said longitudinally extending sections (16–18).

10. The cable according to claim 8, wherein a large transverse dimension (b) of said longitudinally extending sections (16–18) is approximately three times that of a small transverse dimension (a) of said longitudinally extending sections (16–18).

11. The cable according to claim 1, wherein said third one (17) of said longitudinally extending sections (16–18) includes a cable support line for relieving longitudinal forces applied to said multi-core flat type cable (15).

12. The cable according to claim 11, wherein a large transverse dimension (b) of said longitudinally extending sections (16–18) is approximately three times that of a small transverse dimension (a) of said longitudinally extending sections (16–18).

13. The cable according to claim 2, wherein a large transverse dimension (b) of said longitudinally extending sections (16–18) is approximately three times that of a small transverse dimension (a) of said longitudinally extending sections (16–18).

* * * * *

UNITED STATES PATENT AND TRADEMARK OFFICE

CERTIFICATE OF CORRECTION

PATENT NO. :5,750,932
DATED :May 12, 1998
INVENTOR(S) :Gunnar C. HANSSON

It is certified that error appears in the above-identified patent and that said Letters Patent is hereby corrected as shown below:

Column 6, line 29 (claim 13, line 1), change "claim 2" to --claim 1--.

Signed and Sealed this

Eleventh Day of July, 2000

*Attest:*

Q. TODD DICKINSON

*Attesting Officer*

*Director of Patents and Trademarks*